US011035617B2

(12) United States Patent
Jensen

(10) Patent No.: US 11,035,617 B2
(45) Date of Patent: Jun. 15, 2021

(54) HEAT TRANSFER PLATE FOR PLATE-AND-SHELL HEAT EXCHANGER AND PLATE-AND-SHELL HEAT EXCHANGER WITH THE SAME

(71) Applicant: Danfoss A/S, Nordborg (DK)

(72) Inventor: Bent Jensen, Nordborg (DK)

(73) Assignee: DANFOSS A/S, Nordborg (DK)

( * ) Notice: Subject to any disclaimer, the term of this patent is extended or adjusted under 35 U.S.C. 154(b) by 67 days.

(21) Appl. No.: 16/196,526

(22) Filed: Nov. 20, 2018

(65) Prior Publication Data

US 2019/0154349 A1 May 23, 2019

(30) Foreign Application Priority Data

Nov. 22, 2017 (DK) ..... PA201700669

(51) Int. Cl.

| | |
|---|---|
| ***F28D 9/00*** | (2006.01) |
| ***F28F 3/08*** | (2006.01) |
| ***F28F 21/08*** | (2006.01) |
| ***F28F 9/00*** | (2006.01) |

(52) U.S. Cl.

CPC ..... *F28D 9/0043* (2013.01); *F28D 9/0006* (2013.01); *F28D 9/0012* (2013.01); *F28D 9/0018* (2013.01); *F28F 3/08* (2013.01); *F28F 9/005* (2013.01); *F28F 21/083* (2013.01)

(58) Field of Classification Search

CPC ... F28F 3/00; F28F 3/08; F28F 21/083; F28D 9/00; F28D 9/005; F28D 9/0006; F28D 9/0012; F28D 9/0043; F28D 9/0068

USPC ..... 165/166, 167

See application file for complete search history.

(56) References Cited

U.S. PATENT DOCUMENTS

| | | | | |
|---|---|---|---|---|
| 5,823,253 | A * | 10/1998 | Kontu | F28D 9/0012 165/167 |
| 10,066,874 | B2 * | 9/2018 | Pitkanen | B23P 15/26 |
| 10,156,401 | B2 * | 12/2018 | Blanchard | F28D 9/0006 |
| 10,393,448 | B2 * | 8/2019 | Rondet | F28D 9/0012 |
| 2003/0000688 | A1 * | 1/2003 | Mathur | F28D 9/0006 165/167 |

(Continued)

FOREIGN PATENT DOCUMENTS

| | | |
|---|---|---|
| CN | 104089503 A | 10/2014 |
| EP | 0781972 A2 | 7/1997 |

(Continued)

OTHER PUBLICATIONS

Extended European Search Report for Serial No. EP 18 20 0293 dated Apr. 17, 2019.

(Continued)

*Primary Examiner* — Len Tran
*Assistant Examiner* — Gustavo A Hincapie Serna
(74) *Attorney, Agent, or Firm* — McCormick, Paulding & Huber PLLC

(57) ABSTRACT

A heat transfer plate (10) for a plate-and-shell heat exchanger (100), the heat transfer plate (10) includes a plate body (11) having first and second sides (111, 112) opposite to each other in a direction perpendicular to the plate body (11); and a projection (12) protruding from the plate body (11) in a direction from the first side (111) towards the second side (112), extending along a segment (115S) of a periphery (115) of the plate body (11), and having a first end (121) and a second end (122).

15 Claims, 5 Drawing Sheets

(56) References Cited

U.S. PATENT DOCUMENTS

2004/0031600 A1* 2/2004 Kontu ..... F28D 9/0043 165/167
2005/0039896 A1* 2/2005 Laine ..... F28D 9/0012 165/157
2006/0118284 A1* 6/2006 Tauren ..... F28D 9/005 165/157
2008/0017049 A1 1/2008 O'Connor
2010/0282448 A1* 11/2010 Singh ..... F28F 9/24 165/135
2011/0024082 A1* 2/2011 Bharne ..... F28F 3/083 165/95
2011/0139400 A1* 6/2011 Hallmann ..... F28F 9/001 165/67
2011/0259562 A1* 10/2011 Blomgren ..... F28F 9/005 165/170
2013/0277028 A1* 10/2013 Heinio ..... F28F 3/046 165/166
2015/0129181 A1* 5/2015 John ..... F28D 9/0043 165/157
2016/0025419 A1* 1/2016 Pitkanen ..... F28D 9/0006 165/158
2016/0187076 A1* 6/2016 Blomgren ..... F28F 9/007 165/80.1
2018/0112935 A1* 4/2018 Seo ..... F28D 9/0006
2018/0299273 A1* 10/2018 Cai ..... G01S 17/86
2018/0363990 A1* 12/2018 Rondet ..... F28D 9/0075
2019/0154348 A1* 5/2019 Larsson ..... F28F 9/0075

FOREIGN PATENT DOCUMENTS

EP 2527775 A1 11/2012
EP 2944912 A1 11/2015
EP 3112787 A1 1/2017
RU 2100733 C1 12/1997
RU 2569406 C1 11/2015
WO 03006911 A1 1/2003
WO 2007076985 A2 7/2007
WO 2008046952 A1 4/2008
WO 2012159882 A1 11/2012
WO 2016168932 A1 10/2016
WO WO-2018019182 A1 * 2/2018 ..... F28D 9/00

OTHER PUBLICATIONS

Danish Search Report for Serial No. PA 2017 00669 dated May 1, 2018.

* cited by examiner

HEAT TRANSFER PLATE FOR PLATE-AND-SHELL HEAT EXCHANGER AND PLATE-AND-SHELL HEAT EXCHANGER WITH THE SAME

CROSS-REFERENCE TO RELATED APPLICATION

This application claims foreign priority benefits under U.S.C. § 119 to Denmark Patent Application No. PA201700669 filed on Nov. 22, 2017, the content of which is hereby incorporated by reference in its entirety.

TECHNICAL FIELD

Embodiments of the present disclosure relates to a heat transfer plate for a plate-and-shell heat exchanger and a plate-and-shell heat exchanger.

BACKGROUND

A typical plate-and-shell heat exchanger comprises a shell and a plurality of heat transfer plates stacked on a top of each other in the cavity of the shell. The heat transfer plates are formed with patterns such that first and second flow paths respectively formed between the neighboring heat transfer plates are alternately arranged in a direction perpendicular to the heat transfer plates. The shell comprises: a peripheral wall; a first inlet port and a first outlet port formed in the peripheral wall; an end wall; and a second inlet port and a second outlet port formed in the end wall. When first fluid enters the shell from the first inlet port, it tends to bypass central regions of the heat transfer plates where the patterns are formed, and to flow from the first inlet port to the first outlet port along peripheries of the heat transfer plates since a flow resistance along the peripheries of the heat transfer plates is lower than that of the central regions of the heat transfer plates where the patterns are formed, thereby resulting in a non-uniform distribution of the first fluid.

SUMMARY

The present disclosure provides a heat transfer plate for a plate-and-shell heat exchanger and a plate-and-shell heat exchanger that at least partly alleviate the non-uniform distribution of the first fluid.

Embodiments of the present disclosure provide a heat transfer plate for a plate-and-shell heat exchanger. The heat transfer plate comprises: a plate body having first and second sides opposite to each other in a direction perpendicular to the plate body; and a projection protruding from the plate body in a direction from the first side towards the second side, extending along a segment of a periphery of the plate body, and having a first end and a second end.

According to embodiments of the present disclosure, the projection comprises two projections each extending along a segment of the periphery of the plate body, and the heat transfer plate further comprises: a first gap formed between the first ends of the two projections to form a first inlet; and a second gap formed between the second ends of the two projections to form a first outlet.

According to embodiments of the present disclosure, the plate body has an essentially circular shape, and the projection extends along a curved line or an arc.

According to embodiments of the present disclosure, the projection is spaced away from the periphery of the plate body.

According to embodiments of the present disclosure, the heat transfer plate further comprises: a blocking protrusion protruding from the plate body in the direction from the first side towards the second side, and extending from the projection to the periphery of the plate body.

According to embodiments of the present disclosure, each of a first distance between the first ends of the two projections and a second distance between the second ends of the two projections is less than a length of each of the two projections, or ½ of the length of each of the two projections.

According to embodiments of the present disclosure, the plate body has an essentially circular shape, and a central angle corresponding to the projection is greater than 90 or 120 degrees.

According to embodiments of the present disclosure, a first distance between the first ends of the two projections is greater than a second distance between the second ends of the two projections.

According to embodiments of the present disclosure, the heat transfer plate further comprises: a first opening formed in the plate body to form a second inlet; and a second opening formed in the plate body to form a second outlet. One of the first inlet and the first outlet, and one of the second inlet and the second outlet are located on one of two sides opposite in a direction parallel to the plate body, while the other of the first inlet and the first outlet, and the other of the second inlet and the second outlet are located on the other of the two sides.

According to embodiments of the present disclosure, the first inlet and the second inlet are located on one of the two sides, while the first outlet and the second outlet are located on the other of the two sides.

According to embodiments of the present disclosure, each of the two projections extends continuously.

Embodiments of the present disclosure also provide a plate-and-shell heat exchanger. The plate-and-shell heat exchanger comprises: a shell defining a cavity; and a plurality of heat transfer plates mentioned above, which are stacked on a top of each other in the cavity of the shell.

According to embodiments of the present disclosure, the shell comprises a peripheral wall extending in a peripheral direction around the plurality of heat transfer plates, and a first inlet port and a first outlet port which are formed in the peripheral wall, and the plate-and-shell heat exchanger further comprises: a blocking piece located between an inner wall surface of the peripheral wall of the shell and the plate bodies of the plurality of heat transfer plates, and between the first inlet port and the first outlet port in the peripheral direction.

According to embodiments of the present disclosure, the blocking piece abuts against the projection of each of the plurality of heat transfer plates.

According to embodiments of the present disclosure, the blocking piece is made of stainless steel.

These and other objects, features and advantages of the present disclosure will become apparent in light of the detailed description of embodiments thereof, as illustrated in the accompanying drawings.

DETAILED DESCRIPTION

Figure 1:
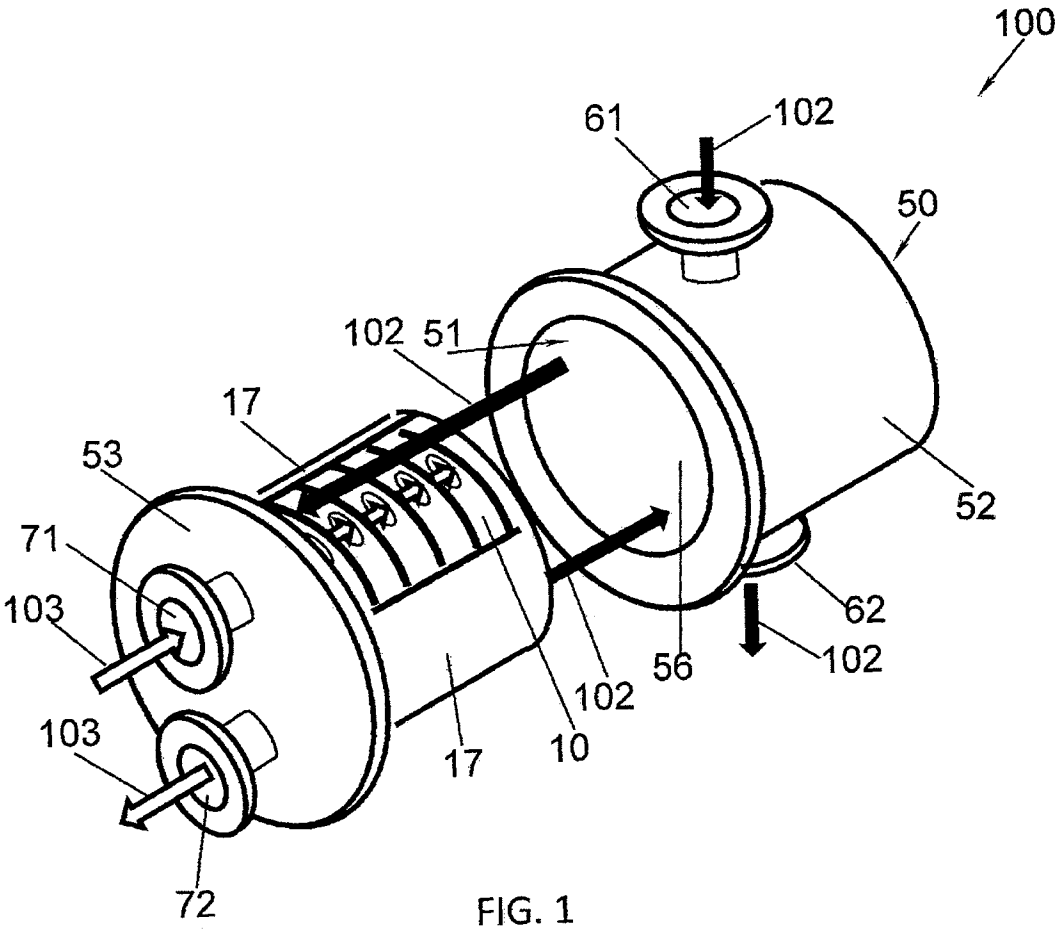
FIG. 1 is a schematic diagram of a plate-and-shell heat exchanger according to an embodiment.
Figure 2:
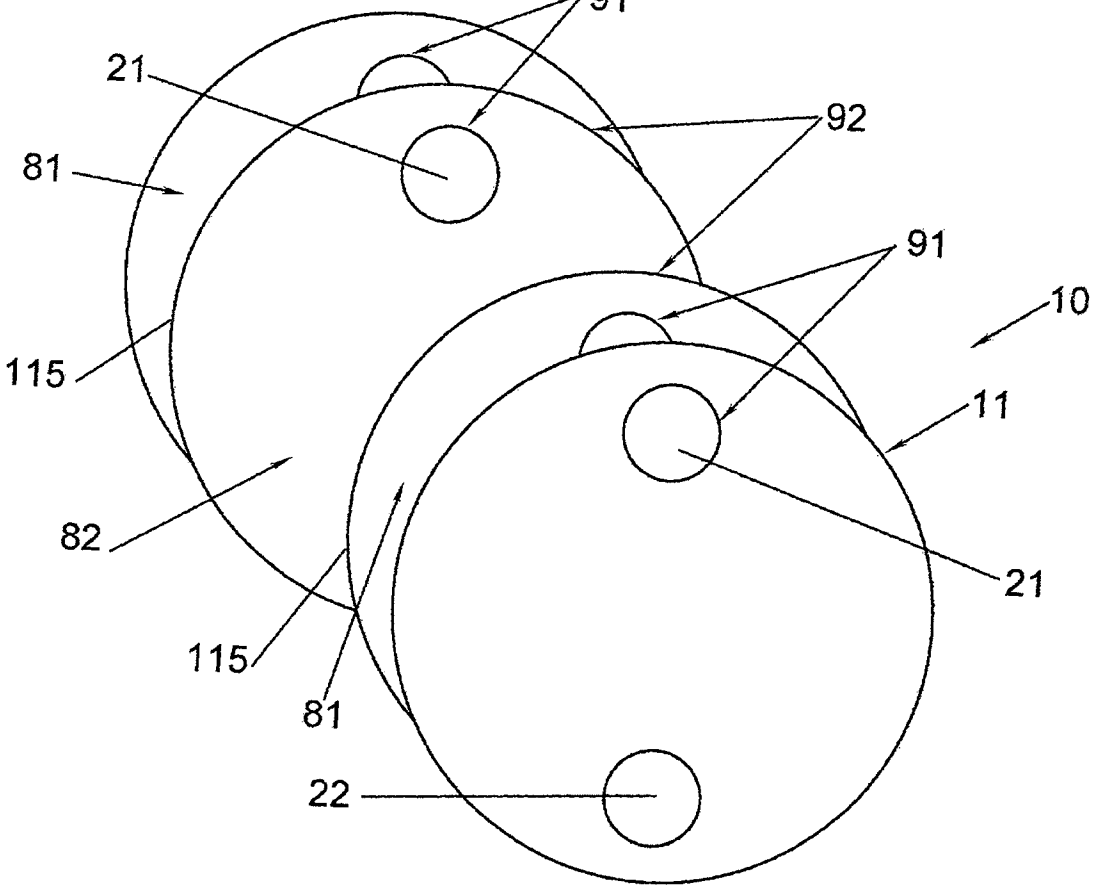
FIG. 2 is a schematic diagram showing heat transfer plates of the plate-and-shell heat exchanger of FIG. 1.
Figure 3:
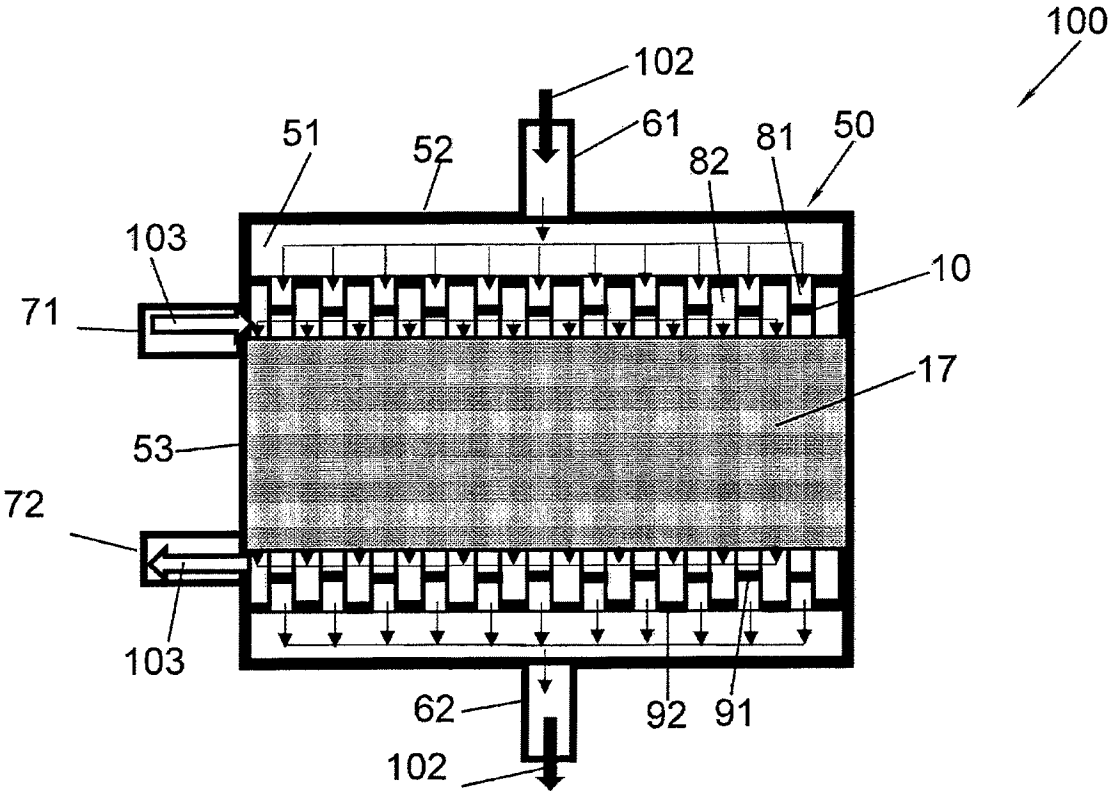
FIG. 3 is a schematic diagram showing an internal structure of the plate-and-shell heat exchanger of FIG. 1.

Referring to FIGS. 1-3, a plate-and-shell heat exchanger 100 according to an embodiment of the present disclosure comprises: a shell 50 defining a cavity 51; and a plurality of heat transfer plates 10 which are stacked on a top of each other in the cavity 51 of the shell 50. The shell 50 may have a cylindrical shape or any other appropriate shape.

Referring to FIGS. 1-3, the shell 50 comprises a peripheral wall 52 extending in a peripheral direction around the plurality of heat transfer plates 10, and a first inlet port 61 and a first outlet port 62 which are formed in the peripheral wall 52. The shell 50 further comprises an end wall 53 such as a cover, and a second inlet port 71 and a second outlet port 72 which are formed in the end wall 53. The heat transfer plates 10 are formed with patterns such that first flow paths 81 and second flow paths 82 respectively formed between the neighboring heat transfer plates 10 are alternately arranged in a direction perpendicular to the heat transfer plates 10 or an axial direction of the shell 50. Sealing pieces 91 are formed around the openings 21 and 22 of the heat transfer plates 10, and sealing pieces 92 are formed around peripheries 115 of the heat transfer plates 10 so that first fluid 102 enters the first flow paths 81 through the first inlet port 61 and flows out of the plate-and-shell heat exchanger 100 through the first outlet port 62, while second fluid 103 enters the second flow paths 82 through the second inlet port 71 and flows out of the plate-and-shell heat exchanger 100 through the second outlet port 72.

Figure 4:
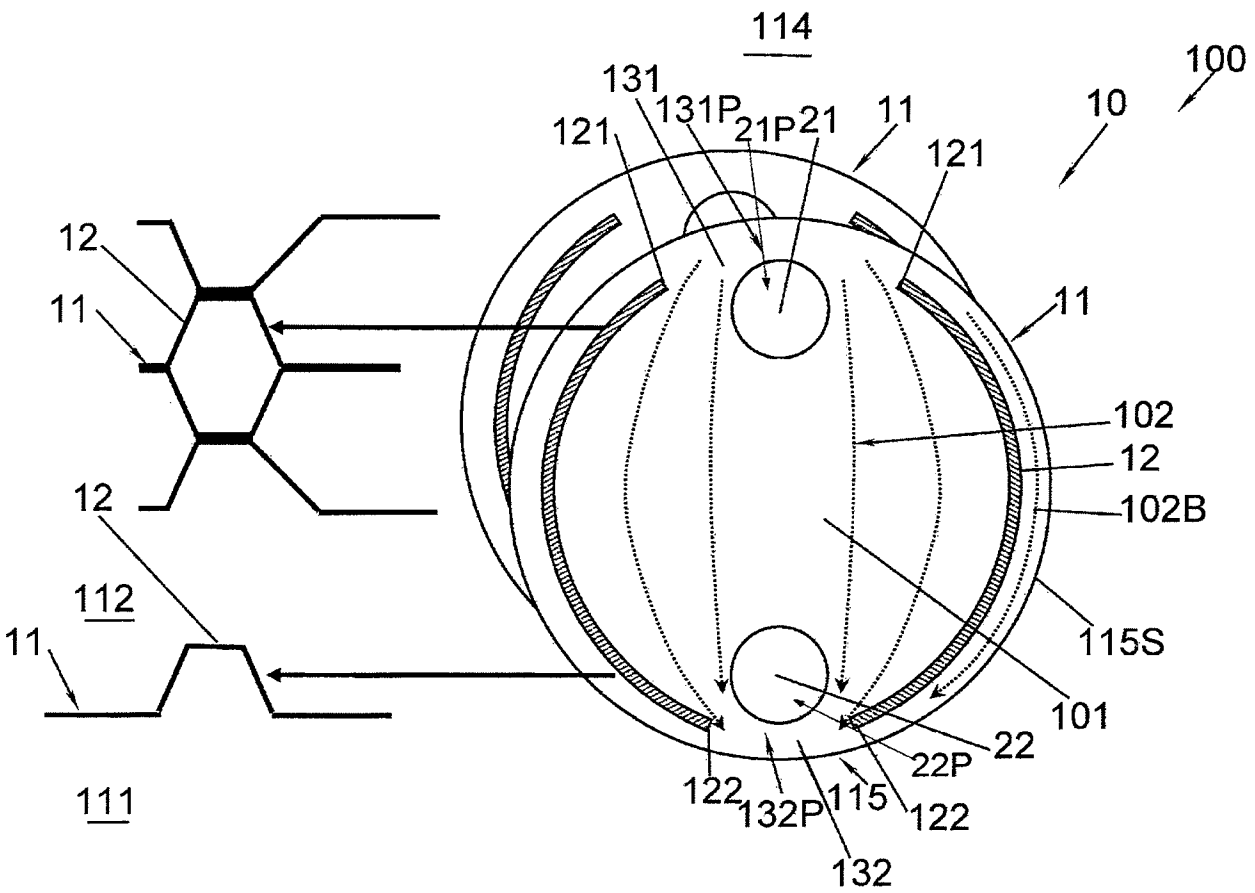
FIG. 4 is a schematic diagram of a heat transfer plate according to an embodiment of the present disclosure.
Figure 5:
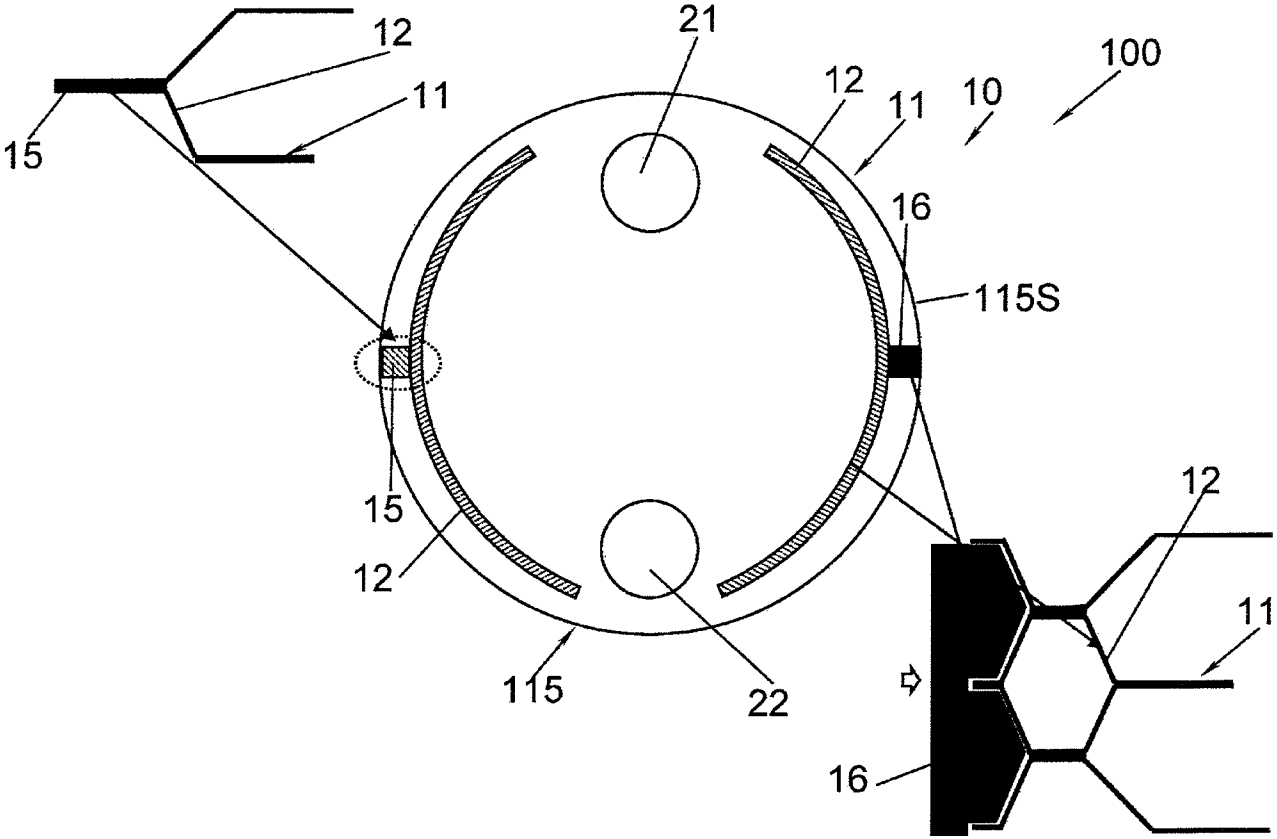
FIG. 5 is a schematic diagram of a heat transfer plate according to another embodiment of the present disclosure.

Referring to FIGS. 4 and 5, in an embodiment, the heat transfer plate 10 comprises: a plate body 11 having first and second sides 111, 112 opposite to each other in a direction perpendicular to the plate body 11; and a projection 12 protruding from the plate body 11 in a direction from the first side 111 towards the second side 112, extending along a segment 115S of a periphery 115 of the plate body 11, and having a first end 121 and a second end 122. The projection 12 may be spaced away from the periphery 115 of the plate body 11.

Referring to FIGS. 4 and 5, the projection 12 comprises two projections 12 each extending along a segment 115S of the periphery 115 of the plate body 11, and the heat transfer plate 10 further comprises: a first gap 131 formed between the first ends 121 of the two projections 12 to form a first inlet 131P for the first fluid 102; and a second gap 132 formed between the second ends 122 of the two projections 12 to form a first outlet 132P for the first fluid 102. Each of the two projections 12 may extend continuously. With the projections 12 according to the embodiments, the projections 12 partly encircle the central region 101 and form a barrier along these peripheral sections of the heat transfer plates 10 when they are connected together. Thereby most of the first fluid 102 is prevented from entering the regions between the projections 12 and the periphery 115 of the plate body 11 of the heat transfer plates 10, and is forced to flow through the central region 101 from the first inlet 131P to the first outlet 132P. In one embodiment, there is a bypass flow 102B along the periphery 115 of the plate body 11 of the heat transfer plates 10 or between one or both of the projections 12 and the periphery 115 of the plate body 11 of the heat transfer plates 10, but the bypass flow 102B will improve the heat exchanging efficiency of the plate-and-shell heat exchanger 100.

Referring to FIGS. 4 and 5, in an embodiment, the plate body 11 has an essentially circular shape, and the projection 12 extends along a curved line or an arc. However, the plate body 11 may have an essentially elliptical shape, an essentially rectangular shape, or the like, while the projection 12 may extend along a segment of an ellipse, a straight line, or the like.

Referring to FIG. 4, in some embodiments, the heat transfer plate 10 may further comprises: a blocking protrusion 15 protruding from the plate body 11 in the direction from the first side 111 towards the second side 112, and extending from the projection 12 to the periphery 115 of the plate body 11. Referring to FIGS. 1 and 4, in other embodiments, the plate-and-shell heat exchanger 100 may further comprises a blocking piece 16 located between an inner wall surface 56 of the peripheral wall 52 of the shell 50 and the plate bodies 11 of the plurality of heat transfer plates 10, and between the first inlet port 61 and the first outlet port 62 in the peripheral direction. The blocking piece 16 may abut against the projection 12 of each of the plurality of heat transfer plates 10. The blocking piece 16 may be made of stainless steel. For example, at least a part of the blocking piece 16 has a comb shape. The blocking piece 16 is a separate element from the heat transfer plate 10. The blocking protrusion 15 and the blocking piece 16 are short than the projection 12 in the peripheral direction. For example, lengths of the blocking protrusion 15 and the blocking piece 16 in the peripheral direction are less than 1/10, 1/15 or the like of a length of the projection 12 in the peripheral direction.

In an embodiment, the heat transfer plate 10 comprises one projection 12. Referring to FIGS. 1 and 3, the plate-and-shell heat exchanger 100 further comprises a sealing member 17 on a side of the heat transfer plates 10 where no projections 12 are provided.

Although FIG. 5 show one blocking protrusion 15 on one side, and one blocking piece 16 on the other side, two blocking protrusions 15, two blocking pieces 16, or two sealing members 17 may be disposed on the two sides, respectively; one sealing member 17 and one blocking protrusion 15 may be disposed on the two sides, respectively; or one sealing member 17 and one blocking piece 16 may be disposed on the two sides, respectively.

In an embodiment, the heat transfer plate 10 comprises: one projection 12. Referring to FIGS. 1 and 3, the plate-and-shell heat exchanger 100 further comprises a sealing member 17 on a side of the heat transfer plates 10 where no projections 12 are provided.

Referring to FIGS. 4 and 5, each of a first distance between the first ends 121 of the two projections 12 and a second distance between the second ends 122 of the two projections 12 may be less than a length of each of the two projections 12, or ½ of the length of each of the two projections 12. For example, the plate body 11 has an essentially circular shape, and a central angle corresponding to the projection 12 is greater than 90 or 120 degrees or the like, so that the projection 12 has an enough length to prevent the first fluid 102 from bypassing a central region 101 of the heat transfer plate 10. The first distance between the first ends 121 of the two projections 12 may be greater than the second distance between the second ends 122 of the two projections 12. The sealing member 17 may have substantially the same length as the projection 12. For example, a central angle corresponding to the sealing member 17 is greater than 90 or 120 degrees or the like, so that the sealing member 17 has an enough length in the peripheral direction to prevent the first fluid from bypassing the central region 101 of the heat transfer plate 10.

According to the embodiments of the present disclosure, the blocking protrusion 15, the blocking piece 16 and/or the sealing member 17 can at least partly alleviate the bypass flow 102B along the periphery 115 of the plate body 11 of the heat transfer plates 10 or between one or both projections 12 and the periphery 115 of the plate body 11 of the heat transfer plates 10.

Referring to FIGS. 4 and 5, in some embodiments, the heat transfer plate 10 further comprises: a first opening 21 formed in the plate body 11 to form a second inlet 21P for the second fluid 103; and a second opening 22 formed in the plate body 11 to form a second outlet 22P for the second fluid 103. One of the first inlet 131P and the first outlet 132P, and one of the second inlet 21P and the second outlet 22P are located on one of two sides 113, 114 opposite in a direction parallel to the plate body 11, while the other of the first inlet 131P and the first outlet 132P, and the other of the second inlet 21P and the second outlet 22P are located on the other of the two sides 113, 114. For example, the first inlet 131P and the second inlet 21P are located on one (for example an upper side) of the two sides 113, 114, while the first outlet 132P and the second outlet 22P are located on the other (for example a lower side) of the two sides 113, 114.

With the heat transfer plate 10 and the plate-and-shell heat exchanger 100 according to the embodiments of the present disclosure, the non-uniform distribution of the first fluid 102 can be at least partly alleviated.

While the principles of the present disclosure have been described herein, it is to be understood by those skilled in the art that this description is made only by way of example and not as a limitation as to the scope of the disclosure. Other embodiments are contemplated within the scope of the present disclosure in addition to the exemplary embodiments shown and described herein. Modifications and substitutions by one of ordinary skill in the art is considered to be within the scope of the present disclosure. This includes that the materials such as the heat transfer plates 10, sealing members 17 etc., could be made of whatever materials would be suitable, like stainless steel, titanium etc.

What is claimed is:

1. A heat transfer plate for a plate-and-shell heat exchanger, the heat transfer plate comprising:

a plate body having first and second sides opposite to each other in a direction perpendicular to the plate body; and a projection protruding from the plate body in a direction from the first side towards the second side, extending along a segment of a periphery of the plate body, and having a first end and a second end;

wherein:

the projection comprises two projections each extending along the segment of the periphery of the plate body, and the heat transfer plate further comprises:

a first gap formed between the first ends of the two projections to form a first inlet; and a second gap formed between the second ends of the two projections to form a first outlet;

further comprising:

a first opening formed in the plate body to form a second inlet; and a second opening formed in the plate body to form a second outlet, wherein:

one of the first inlet and the first outlet, and one of the second inlet and the second outlet are located on one of two sides opposite in a direction parallel to the plate body, while the other of the first inlet and the first outlet, and the other of the second inlet and the second outlet are located on the other of the two sides.

2. The heat transfer plate of claim 1, wherein:

the plate body has a circular shape, and the projection extends along a curved line or an arc.

3. The heat transfer plate of claim 1, wherein:

the projection is spaced away from the periphery of the plate body.

4. The heat transfer plate of claim 3, further comprising:

a blocking protrusion protruding from the plate body in the direction from the first side towards the second side, and extending from the projection to the periphery of the plate body.

5. The heat transfer plate of claim 1, wherein:

each of a first distance between the first ends of the two projections and a second distance between the second ends of the two projections is less than a length of each of the two projections, or half of the length of each of the two projections.

6. The heat transfer plate of claim 1, wherein:

the plate body has a circular shape, and a central angle corresponding to the projection is greater than 90 or 120 degrees.

7. The heat transfer plate of claim 1, wherein:

a first distance between the first ends of the two projections is greater than a second distance between the second ends of the two projections.

8. The heat transfer plate of claim 1, wherein:

the first inlet and the second inlet are located on one of the two sides, while the first outlet and the second outlet are located on the other of the two sides.

9. The heat transfer plate of claim 1, wherein:

each of the two projections extends continuously.

10. A plate-and-shell heat exchanger, comprising:

a shell defining a cavity; and a plurality of heat transfer plates of claim 1, which are stacked on a top of each other in the cavity of the shell.

11. The plate-and-shell heat exchanger of claim 10, wherein:

the shell comprises a peripheral wall extending in a peripheral direction around the plurality of heat transfer plates, and a first inlet port and a first outlet port which are formed in the peripheral wall, and the plate-and-shell heat exchanger further comprises:

a blocking piece located between an inner wall surface of the peripheral wall of the shell and the plate bodies of the plurality of heat transfer plates, and between the first inlet port and the first outlet port in the peripheral direction.

12. The plate-and-shell heat exchanger of claim 11, wherein:

the blocking piece abuts against the projection of each of the plurality of heat transfer plates.

13. The plate-and-shell heat exchanger of claim 11, wherein:

the blocking piece is made of stainless steel.

14. The heat transfer plate of claim 1, wherein:

each of a first distance between the first ends of the two projections and a second distance between the second ends of the two projections is less than half of the length of each of the two projections.

15. A plate-and-shell heat exchanger, comprising:

a shell defining a cavity; and a plurality of heat transfer plates, which are stacked on a top of each other in the cavity of the shell, each heat transfer plate comprising:

a plate body having first and second sides opposite to each other in a direction perpendicular to the plate body; and a first projection and a second projection each protruding from the plate body in a direction from the first side towards the second side, extending along a segment of a periphery of the plate body, and having a first end and a second end; a first gap formed between the first ends of the two projections to form a first inlet; and a second gap formed between the second ends of the two projections to form a first outlet;

wherein:

the shell comprises a peripheral wall extending in a peripheral direction around the plurality of heat transfer plates, and a first inlet port and a first outlet port which are formed in the peripheral wall, and the plate-and-shell heat exchanger further comprises:

a first blocking piece and a second blocking piece each located between an inner wall surface of the peripheral wall of the shell and the plate bodies of the plurality of heat transfer plates, and between the first inlet port and the first outlet port in the peripheral direction; and the first blocking piece abuts against the first projection of each of the plurality of heat transfer plates and the second blocking piece abuts against the second projection of each of the plurality of heat transfer plates.

* * * * *